US006261194B1

(12) United States Patent
Hadar et al.

(10) Patent No.: US 6,261,194 B1
(45) Date of Patent: Jul. 17, 2001

(54) CONNECTING BLOCKING SLED

(75) Inventors: Joseph C. Hadar; Wayne A. Miner, both of Humboldt, IA (US)

(73) Assignee: Hadar Mfg., Inc., Humboldt, IA (US)

( * ) Notice: Subject to any disclaimer, the term of this patent is extended or adjusted under 35 U.S.C. 154(b) by 0 days.

(21) Appl. No.: 09/442,613

(22) Filed: Nov. 18, 1999

(51) Int. Cl.[7] ..... A63B 69/34
(52) U.S. Cl. ..... 473/441; 473/422; 473/445
(58) Field of Search ..... 473/438–445, 473/FOR 124, FOR 125; 269/1, 32, 166; 29/242, 243

(56) References Cited

U.S. PATENT DOCUMENTS

| | | | | |
|---|---|---|---|---|
| 2,237,600 | | 4/1941 | Gilman . | |
| 2,653,816 | * | 9/1953 | Young et al. | 473/445 |
| 2,934,343 | | 4/1960 | Schumacher . | |
| 3,216,724 | | 11/1965 | Williams . | |
| 3,329,428 | | 7/1967 | Moran . | |
| 3,514,105 | | 5/1970 | Pillard . | |
| 3,674,265 | * | 7/1972 | Sheets et al. | 473/441 |
| 3,804,410 | | 4/1974 | Gilman . | |
| 3,827,690 | * | 8/1974 | Rogers | 473/445 |
| 4,477,083 | * | 10/1984 | Sowards | 473/423 |
| 4,688,795 | * | 8/1987 | Callaway, Jr. | 473/438 |
| 5,090,696 | * | 2/1992 | Forrest, Sr. | 473/444 |
| 5,385,523 | * | 1/1995 | Forrest | 473/445 |

* cited by examiner

*Primary Examiner*—Jeanette Chapman
*Assistant Examiner*—Mitra Aryanpour
(74) *Attorney, Agent, or Firm*—G. Brian Pingl

(57) ABSTRACT

Football practice equipment which can be in the form of a one-man tackling sled or a multiple-man blocking sled equipped with connecting apparatus. By connecting tackling sleds together, a blocking sled can be created upon which is mounted the desired number of dummies for use in training football players in the art of blocking and tackling, individually or in team formations. The tackling sleds are connected together to form multiple dummy blocking sleds by attaching connecting members between as many of the tackling sleds as desired. The connection between the tackling sleds is made via channel members on the tackling sleds with locking handles for securing the connecting members in their associated channel members.

2 Claims, 3 Drawing Sheets

11
12
14
16
18
20
22
24
26
28
30
32
34
36
38
40
42
44
46
48
50
52
54
56

12
14
16
18
20
22
24
26
28
30
32
34
36
38
40
42
44
46
48
50
52
54
56

CONNECTING BLOCKING SLED

BACKGROUND OF THE INVENTION

1. Field of the Invention

This invention relates in general to football practice equipment, and more particularly, to the connecting of multiple tackling sleds together to form variable unit blocking sleds for use in teaching and practicing blocking and tackling techniques.

2. Description of the Prior Art

It is important in the training of football players to provide opportunities for the players to practice their blocking techniques. These blocking techniques are traditionally taught using both tackling sleds with one dummy and blocking sleds with multiple dummies. This allows the players to learn the skills necessary to block and tackle safely and efficiently and those skills needed for the combined activity of players.

Because of the contact nature of football, professional teams and schools with football programs must purchase a wide variety of training and safety equipment. Purchasing a number of one-man tackling sleds and a variety of blocking sleds with different numbers of dummies can be prohibitively expensive (especially for smaller school districts), difficult to store, and inefficient to use. However, without training in these various contexts, a player may be unequipped to meet the challenges on the playing field and become injured.

Blocking sleds have been used for many years. Prior art teaches blocking sleds with multiple dummies. See U.S. Pat. No. 3,216,724 to Williams and U.S. Pat. No. 2,237,600 to Gilman. Blocking sleds that include platforms upon which a person stands to add resistance are also taught by the prior art. See U.S. Pat. No. 5,385,523 to Forrest and U.S. Pat. No. 2,237,600 to Gilman. There are sleds that include dummies that display movement and resistance in a variety of planes and angles. See U.S. Pat. No. 5,385,523 to Forrest; U.S. Pat. No. 2,934,343 to Schumacher; U.S. Pat. No. 3,514,105 to Pillard; U.S. Pat. No. 3,329,428 to Moran; and U.S. Pat. No. 3,216,724 to Williams. The prior art even discloses sleds upon which multiple dummies can be mounted as needed. See U.S. Pat. No. 3,804,410 to Gilman; U.S. Pat. No. 5,385,523 to Forrest; and U.S. Pat. No. 2,934,343 to Schumacher. However, many of the sleds that allow dummies to be added are not very versatile for training purposes and often employ cumbersome and time consuming processes to combine the dummies on a sled such that changing their configuration during practice is not a practical option. In addition, some of these sleds contemplate placement of structural elements for combining or extending the sled in such position or of such permanent dimensions as to present potential danger to the players. For example, U.S. Pat. No. 3,804,410 to Gilman teaches use of a constant length crossbar upon which multiple dummies can be mounted and slid into a variety of positions. However, if only one or two dummies are used, a portion of the frame upon which the dummies are mounted will be empty and hazardous to players running nearby.

It is therefore the object of the present invention to provide affordable, one-man tackling sleds which can be releasably and safely connected together, without tools or requiring unreasonable amounts of time, to form variable unit blocking sleds.

It is another object of the present invention to provide tackling sleds with multiple dummies which can be releasably and safely connected together, without tools, to form variable unit blocking sleds.

It is another object of the present invention to provide variable unit blocking sleds that allow line-splits to be tailored according to needs of the practice drill.

It is yet another object of the present invention to allow this versatility without compromising the safety of the players.

SUMMARY

The present invention provides tackling sleds with a connection apparatus for creating a variable unit blocking sled; more specifically, the invention resides in the use of a means to receive a connecting member on each of the tackling sleds and to tighten and secure said receiving means around the connecting member.

The embodiment of this invention results in advantages not provided by tackling sled combinations disclosed in the prior art. The principal advantage of the present invention is that one-man tackling sleds or multiple dummy blocking sleds can be combined to form a variety of configurations quickly and without the use of tools. A football program can purchase the number of one-man tackling sleds appropriate for combination with multiple-dummy blocking sleds for its designed training program and number of players. An advantage of the ability to create any combination using one-man tackling sleds is that storing one-man tackling sleds is much easier and efficient than storing multiple-dummy blocking sleds. Finally, these advantages are provided without compromising the safety of the players.

Other objects, features, and advantages of the present invention will be readily appreciated from the following description. The description makes reference to the accompanying drawings, which are provided for illustration of the preferred embodiment. However, such embodiment does not represent the fill scope of the invention. The subject matter which the inventor does regard as his invention is particularly pointed out and distinctly claimed in the claims at the conclusion of this specification.

DESCRIPTION OF THE PREFERRED EMBODIMENT(S)

Figures 1, 2:
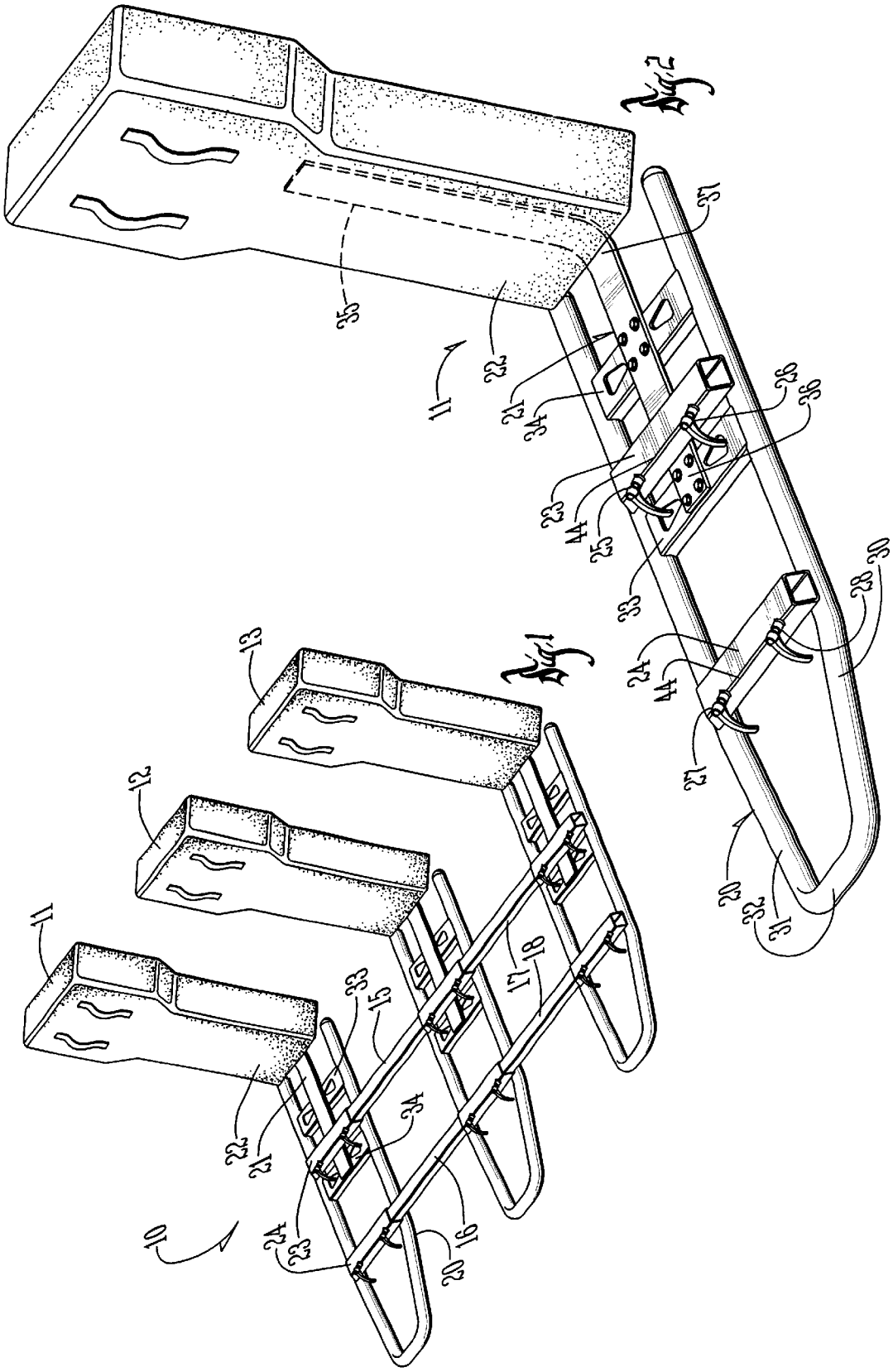
FIG. 1 is a perspective view of a variable unit blocking sled that is formed from three one-man tackling sleds and represents the preferred embodiment of the present invention.
FIG. 2 is a perspective view of one of the one-man tackling sleds embodying the present invention.

A multiple-dummy blocking sled 10 is shown in FIG. 1 that represents a preferred embodiment of the present invention and is used to teach football players appropriate blocking and tackling techniques. The multiple dummy blocking sled 10 is a series of one-man tackling sleds 11, 12, and 13 attached to one another by the use of connecting members 15, 16, 17, 18 to be described.

FIG. 2 shows the one-man tackling sled 11 in greater detail. In view of the fact that the sleds 11, 12 and 13 are of similar construction, only the detail of the construction of the sled 11 will be described. The one-man tackling sled 11 comprises a base structure 20, a post 21, a padded form 22, and receiving means 23 and 24 and securing means 25, 26, 27, 28 which will be explained in more detail.

Figure 3:
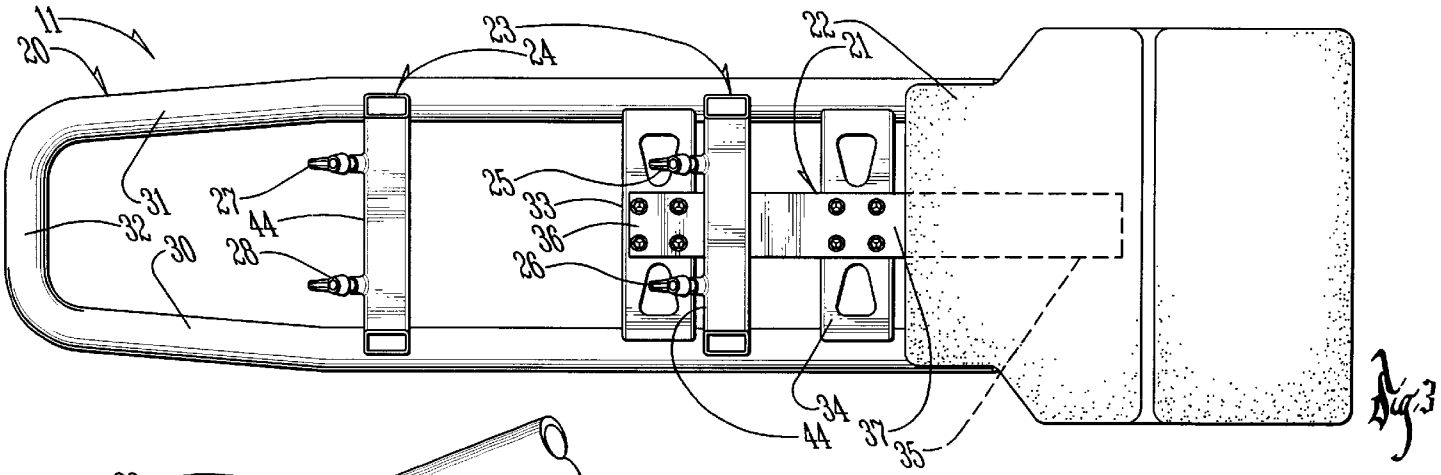
FIG. 3 is a top view of the base structure of the one-man tackling sled of FIG. 2.

Referring now to both FIGS. 2 and 3, the base structure 20 is preferably constructed of metal for durability. The base structure 20 has two arms 30 and 31 connected by a shoulder 32. There are cross members 33 and 34 fixedly attached to the arms 30 and 31. The post 21, having two end portions 35 and 36 connected by a curved middle portion 37 is mounted on the cross members 33 and 34 such that the post end 35 extends upwardly from the ground upon which the sled 11 rests. On the post 21 is mounted the padded form 22.

Figure 4:
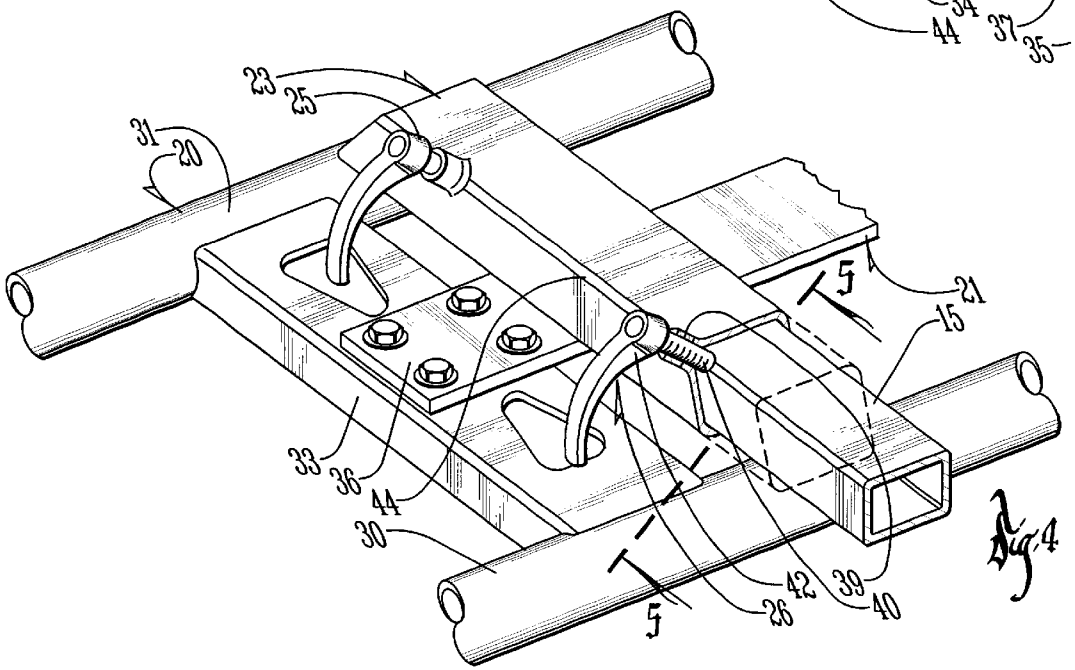
FIG. 4 is an enlarged, perspective view of a center portion of the sled of FIG. 3.
Figure 5:
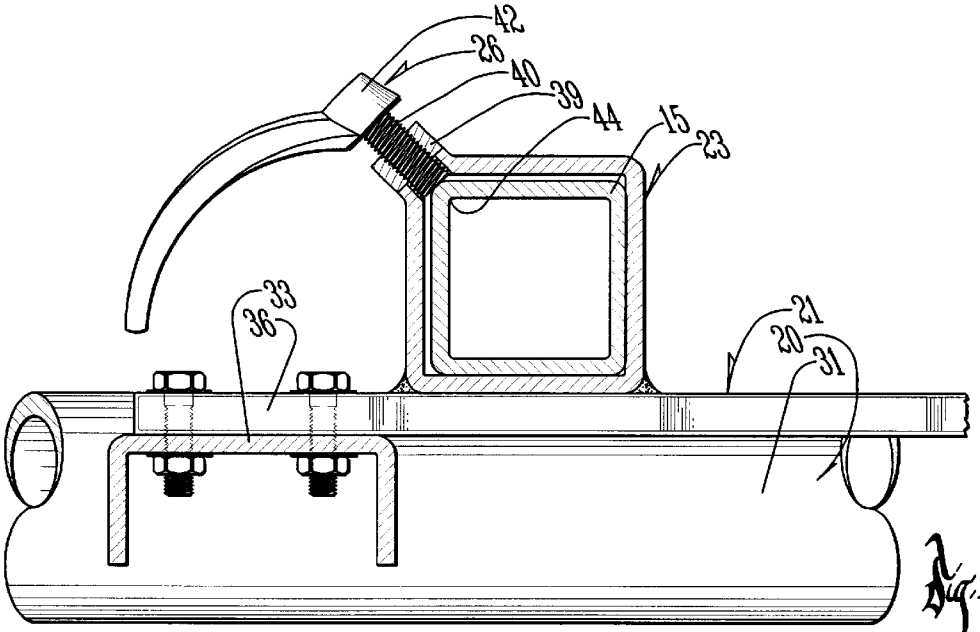
FIG. 5 is an enlarged cross-sectional view taken along line 5—5 in FIG. 4 to show more detail of locking handles included on the tackling sled of FIG. 3.

Upon the base structure 20 of the one man tackling sled 11 are mounted the receiving means 23 and 24. An enlarged perspective view of the receiving means 23 is shown in FIG. 4. On the receiving means 23 are located the securing means 25 and 26. Taken along line 5—5 in FIG. 4, FIG. 5 shows that the securing means 26 comprises threaded passage means 39 through which a threaded stud 40 attached to a handle 42 is turned. In the preferred embodiment, the receiving means 23 is fixedly attached to the base structure 20 either using nut and bolt combinations or welds, and are rectangular, hollow metal tubes. Also in the preferred embodiment the securing means 26 is positioned in the corner 44 of the receiving means 23.

Figure 6:
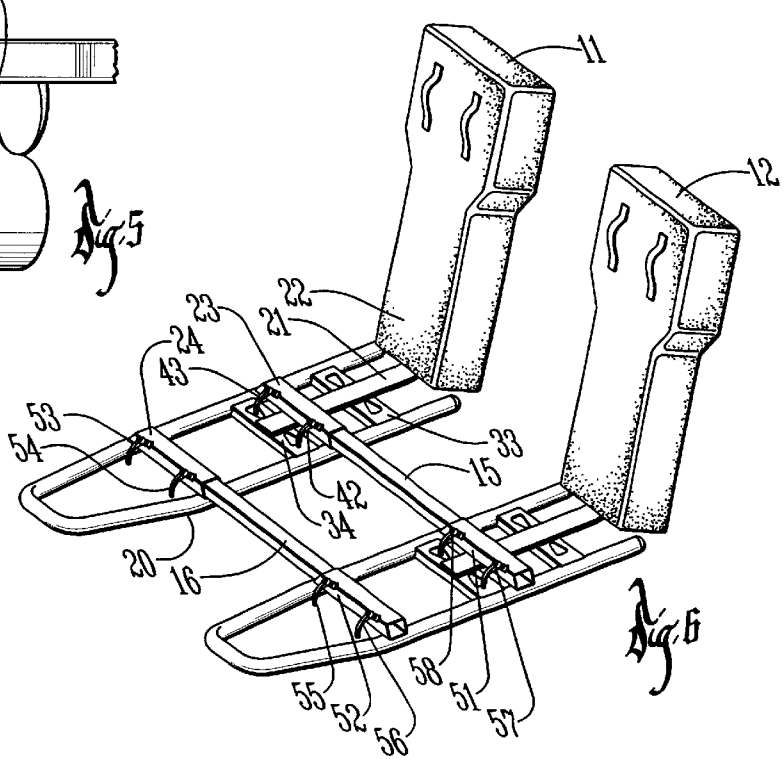
FIG. 6 is a perspective view showing two tackling sleds connected together.

The connecting members 15 and 16 are shaped complimentarily to the receiving means 23 and 24 but of a slightly smaller dimension. In the preferred embodiment as shown in FIG. 6, one-man tackling sleds 11 and 12 are attached to each other by sliding the connecting member 15 into the receiving means 23 and 51 and sliding the connecting member 16 into receiving means 24 and 52. Turning the handles 42, 43, 53, 54, 55, 56, 57, 58 tightens the fit of the connecting members 15 and 16 in the receiving means 23, 24, 51 and 52 such that the two one-man tackling sleds 11 and 12 can be used as a two-man blocking sled. Repeating this process allows additional configurations to be constructed.

Thus, the present invention has been described in an illustrative manner. It is to be understood that the terminology that has been used is intended to be in the nature of words of description rather than of limitation.

Many modifications and variations of the present invention are possible in light of the above teachings. Therefore, within the scope of the appended claims, the present invention may be practiced otherwise than as specifically described.

What We claim is:

1. A blocking sled supported by the ground of multiple one-man tackling sled units attached to each other by connecting member each sled unit comprising:

a) a base structure comprising;
   1) two arms substantially parallel with one another and connected by a shoulder
   2) cross members situated perpendicular to said arms and positioned away from said shoulder;
   3) means to mount said cross members on said arms;
   4 ) a post structure having a first end portion, a second end portion and a middle portion that is curved so that said end portions extend at an angle to one another;
   5) means to mount said post structure on said cross members such that said first end portion of said post is parallel to said arms and said second end portion of said post extends upwardly from the ground;

b) a padded form mounted on said second end portion of said post;

c) receiving means on said base structure shaped complementarily to said connecting members and oriented transversely to said base structure for the slidable receipt of said connecting members; and d) securing means on said receiving means for releasably securing said connecting members therein.

2. A blocking sled as claimed in claim 1 wherein said securing means on each said receiving means for releasably securing said connecting members therein include threaded passage means and a threaded stud with a handle located on its outer end associated with each of said passage means.

* * * * *